US006085362A

United States Patent [19]

Huber

[11] Patent Number: 6,085,362

[45] Date of Patent: Jul. 11, 2000

[54] WATER CLOSET FITTING INSTALLATION ASSEMBLY

[76] Inventor: Donald G. Huber, P.O. Box 64160, Tacoma, Wash. 98404

[21] Appl. No.: 09/350,636

[22] Filed: Jul. 9, 1999

Related U.S. Application Data

[60] Provisional application No. 60/092,322, Jul. 9, 1998.

[51] Int. Cl.[7] ..... E03D 11/16; E03D 11/17

[52] U.S. Cl. ..... 4/252.4; 4/252.1; 138/96 R

[58] Field of Search ..... 4/252.1–252.6; 285/24, 27, 45; 138/90, 92, 94, 94.5, 96 R, 110; 137/68.19; 52/95, 96, 82

[56] References Cited

U.S. PATENT DOCUMENTS

| | | | |
|---|---|---|---|
| 1,720,819 | 7/1929 | Cohen | 138/90 |
| 1,948,220 | 2/1934 | Kennedy | 182/7 |
| 2,596,182 | 5/1952 | Sosaya | 285/33 |
| 3,132,685 | 5/1964 | McKinnon | 158/46.5 |
| 3,319,268 | 5/1967 | Blumenkranz | 4/252 |
| 3,392,409 | 7/1968 | Politz | 4/199 |
| 3,775,780 | 12/1973 | McEwen | 4/252 R |
| 3,952,340 | 4/1976 | Cuschera | 4/252 R |
| 4,052,759 | 10/1977 | Hill | 4/252.4 |
| 4,142,371 | 3/1979 | Mayfield et al. | 405/224 |
| 4,194,252 | 3/1980 | Tsuei | 4/199 |
| 4,212,486 | 7/1980 | Logsdon | 4/252.4 |
| 4,406,480 | 9/1983 | Izzi | 285/12 |
| 4,423,526 | 1/1984 | Izzi, Sr. | 4/252 R |
| 4,429,568 | 2/1984 | Sullivan | 73/49.8 |
| 4,460,019 | 7/1984 | Condon | 138/90 |
| 4,542,642 | 9/1985 | Tagliarino | 73/40.5 R |
| 4,602,504 | 7/1986 | Barber | 73/49.8 |
| 4,658,861 | 4/1987 | Roberson, Sr. | 138/90 |
| 4,669,131 | 6/1987 | Barlow | 4/198 |
| 4,706,482 | 11/1987 | Barber | 73/49.8 |
| 4,780,915 | 11/1988 | Cuschera | 4/252 R |
| 4,823,411 | 4/1989 | Nettel | 4/255 |
| 4,827,539 | 5/1989 | Kiziah | 4/252 R |
| 4,873,730 | 10/1989 | Cuschera | 4/252 R |
| 4,936,350 | 6/1990 | Huber | 138/90 |
| 5,033,510 | 7/1991 | Huber | 138/90 |
| 5,099,887 | 3/1992 | Hooper | 138/89 |
| 5,115,554 | 5/1992 | Fell, Sr. | 4/252.4 |
| 5,377,361 | 1/1995 | Piskula | 4/252.4 |
| 5,623,971 | 4/1997 | Foernzler | 138/89 |
| 5,996,134 | 12/1999 | Senninger | 4/252.4 |

*Primary Examiner*—David J. Walczak
*Assistant Examiner*—Tuan Nguyen
*Attorney, Agent, or Firm*—Garrison & Associates PS; David L. Garrison

[57] ABSTRACT

A water closet fitting installation assembly for installation and optional testing of a water closet fitting within a poured, permanently set floor. The assembly permits the fitting to be rapidly and efficiently installed flush with the floor surface, without risk of fouling the drainage system or blocking drainage of water from the system with slopped or mis-poured floor material such as concrete; facilitates mounting and placement of a water closet stool. Optionally the system further facilitates pressure testing of the drain system after the fitting has been installed, without the necessity of placing permanent structures or other blockages in the drain system. The assembly comprises a water closet fitting; a flange adapted for rotatable engagement of an outer circumference of the fitting, whereby a water closet stool may be attached to the fitting in a desired rotational orientation relative to the fitting by means of mechanical fasteners passing through holes in the flange; a collar adapted to prevent contact between the flange, the fitting, and mechanical fasteners used to mount the stool and the material in which the fitting is installed; and a temporary or removable cover plate adapted to cover the fitting and to prevent unset flooring material from entering the water closet fitting or the drain system on installation, so that the fitting and said the system are kept free from the material, and from potential blockage thereby. Preferred embodiments of the fitting assembly further comprise a test baffle adapted to permit the water closet drain system to be tested for fluid tight integrity after the water closet fitting has been installed, without fouling the drain system with the test baffle or pieces thereof after the test has been completed.

12 Claims, 3 Drawing Sheets

WATER CLOSET FITTING INSTALLATION ASSEMBLY

This application claims the benefit of U.S. provisional patent application Ser. No. 60/092,322, entitled Water Closet Fitting Installation Assembly and filed Jul. 9, 1998.

TECHNICAL FIELD

The invention relates to water closet installation assemblies and drain system fittings. More particularly, it relates to method and apparatus for convenient and efficient flush installation of water closet fittings and stools in poured permanent floors, and for the facilitation of pressure testing of water closet drain systems in poured permanent floors after installation.

BACKGROUND OF THE INVENTION

Water closet fittings and toilet stool drains are frequently installed in concrete and other poured permanent floors. In such floors drainage plumbing for the fixtures, such as a water closet drain system, is typically installed prior to pouring of the floor, before the system can be tested for leaks and before the water closet stool can be mounted over the drain. In these circumstances it is critical to keep the drain clear of foreign matter such as mis-poured or slopped concrete, or other debris capable of fouling or blocking the drainage system, in order to prevent the necessity of removing the floor and replacing or repairing plugged sections of the system. This is especially true in as much as many of the potential obstructions can become permanent, and if allowed to lodge or set permanently can cause the entire system to need digging up and/or replacement. At the same time, it is also highly beneficial to allow the drainage fitting and/or the stool to be mounted flush with the floor, so that the need for shims, platforms, false floors and the like can be alleviated and a safe, effective, and cosmetically appealing installation can be completed. It is also highly beneficial to permit the stool to be installed in selectable rotational alignment with the drain system and the water closet fitting, and to permit the desired alignment to be selected after the floor has been poured and set.

It is further beneficial to facilitate efficient and non-destructive testing of the drain system before the stool is installed but as soon as the system is otherwise complete and ready for testing. In doing so, a newly installed or repaired operating sewage conduit in the building waste or sewer drainage system must frequently be isolated from the sewage service line until the plumbing construction is tested and inspected by subjecting the system to a fluid pressure test to locate any leaks, and certified for compliance with building code requirements. It is common practice within the construction industry to place an outlet end of a newly installed sewage conduit of the building at a juncture near an inlet to a sewage service line. During installation, these two lines are capped and not connected where they would otherwise meet. As a result of usual construction techniques, the future juncture is frequently buried before the tests are performed. After the testing and inspection are complete, the connection site is re-excavated, the caps removed, and a secure connection of the two lines is made.

Various patents have issued disclosing water closet fitting assemblies test or isolation valve assemblies used in the installation or inspection of drain systems prior to connection of the systems to sewer lines. None of them, however, discloses a system which accomplishes each of the stated purposes of the invention disclosed herein simultaneously.

Nor does any of them disclose a means for permitting rapid, efficient, flush installation of a water closet fitting in a permanently set floor without risk of fouling the drain system.

McEwen U.S. Pat. No. 3,775,780, and Kiziah U.S. Pat. No. 4,827,539, disclose water closet fittings comprising flanges which permit some degree of freedom in mounting the water closet stool.

Hooper U.S. Pat. No. 5,099,887, Nettel U.S. Pat. No. 4,823,411, Sosoya U.S. Pat. No. 2,596,182, and Piskula U.S. Pat. No. 5,377,361 disclose various caps for testing and providing spaces around drains during installation.

Sullivan U.S. Pat. No. 4,429,568, discloses a closure plug for pressure testing a liquid drain and vent plumbing type system. Sullivan uses a clean-out Y for access to open the plug plate assembly.

Cohen U.S. Pat. No. 1,720,819, discloses a test tee having a tapered gate which closes off a house drain pipe from a drainage system. After the test has been completed, the gate is removed from the test tee and the resulting opening in the tee is closed by a cover plate.

Tagliarnio U.S. Pat. No. 4,542,642, discloses a test tee having a plug which is a removable blocking disk. The blocking disk engages a ledge in the test tee and seals the drainage system. The diaphragm is accessible and removable through an access means.

Roberson U.S. Pat. No. 4,658,861, discloses a pneumatic plug inserted through a clean-out tee to block off a house service line to the main sewer line.

Kennedy U.S. Pat. No. 4,602,504, discloses a test plumbing system using a flap valve which is pivoted at an upper side of the valve seat. The flap valve is held in position by a valve adjusting rod.

Barber U.S. Pat. No. 4,602,504, shows a permanently installed test fitting in which a seal diagram has a frangible, removable portion which may be broken away from the diaphragm and removed to permit service use of the system. A portion of the seal diaphragm remains permanently in the conduit with its edge exposed.

Huber U.S. Pat. Nos. 4,848,155, 4,936,350, 5,033,510, and 5,163,480 have disclosed various apparatus for isolating and testing plumbing installations.

None of these references teaches methods or apparatus suited for use in water closet or other fitting installations made in poured, permanently set floors, where access to the fittings and to the test or isolation apparatus is impractical or impossible once the fitting has been installed. Nor do any of the references teach or suggest means for isolating a water closet drain system by means of an apparatus which allows selective rotational setting of the water closet stool after the water closet drain has been installed in a permanently set floor. This latter ability is highly advantageous in most construction situations, where minor nuances in alignment and spacing can be critical, particularly in the close, starkly decorated environment typical of water closets. Many of the inventions disclosed in these references suffer from the permanent presence of apparatus in the conduit which can catch refuse and cause pluggage. Nor, again, do any of them disclose a means for permitting rapid, efficient, flush installation of a water closet fitting in a permanently set floor without risk of fouling the drain system, particularly in combination with the other capabilities described above.

Thus there exists a need for a water closet installation assembly adapted for facilitating the rapid, efficient, flush installation of a water closet fitting in a permanently set floor without risk of fouling the drain system, and in particular of fouling the drain system with permanently setting materials. There further exists a need for such a water closet fitting which is also adapted for facilitation of the testing of water closet drain systems, without danger of permanently fouling or obstructing the drain system, and which is easy and convenient to install and operate in poured, permanently set flooring in which access to the fitting and to the drain system will be restricted or prevented. There is a further need for such systems which allow water closet stools to be set in a selectable rotational position with respect to the installed drain system and the permanent floors in which the drain systems are set.

DISCLOSURE OF THE INVENTION

Accordingly, it is an object of the invention to provide a water closet installation assembly adapted for facilitating the rapid, efficient, flush installation of a water closet fitting in a permanently set floor without risk of fouling the drain system, and in particular of fouling the drain system with permanently-setting materials. It is a further object of the invention to provide such a water closet fitting which is also adapted for facilitating the testing of water closet drain systems, without danger of permanently fouling or obstructing the drain system, and which is easy and convenient to install and operate in poured, permanently set flooring in which access to the fitting and to the drain system will be restricted or prevented. It is still a further object of the invention to provide such systems which allow water closet stools to be set in a selectable rotational position with respect to the installed drain system and the permanent floors in which the drain systems are set.

It is a further object of the invention to provide each of the above described systems and apparatus in an economical, easy to use embodiment, capable of being produced by efficient and cost-effective production means.

It is yet another object of the invention to meet any or all of the needs summarized above.

These and such other objects of the invention as will become evident from the disclosure below are met by the invention disclosed herein.

The invention addresses and provides such a system. The invention provides a water closet fitting installation assembly for installation and optional testing of a water closet fitting within a poured, permanently set floor. The assembly permits the fitting to be rapidly and efficiently installed flush with the floor surface, without risk of fouling the drainage system or blocking drainage of water from the system with slopped or mispoured floor material such as concrete; and facilitates mounting and placement of a water closet stool. Optionally the system further facilitates pressure testing of the drain system after the fitting has been installed, without the necessity of placing permanent structures or other blockages in the drain system. The assembly comprises a water closet fitting; a flange adapted for rotatable engagement of an outer circumference of the fitting whereby a water closet stool may be attached to the fitting in a desired rotational orientation relative to the fitting by means of mechanical fasteners passing through holes in the flange; a collar adapted to prevent contact between the flange, the fitting, and fasteners used to mount the stool, and the material in which the fitting is installed; and a temporary or removable cover plate adapted to cover the fitting and to prevent unset flooring material from entering the water closet fitting or the drain system on installation, so that the fitting and said the system are kept free from the material, and from potential binding or blockage thereby. Preferred embodiments of the fitting assembly further comprise a test baffle adapted to permit the water closet drain system to be tested for fluid tight integrity after the water closet fitting has been installed, without fouling the drain system with the test baffle or pieces thereof after the test has been completed.

In one aspect the invention comprises a water closet fitting installation assembly for installation of a water closet fitting within a poured, permanently set floor. The assembly comprises a water closet fitting and a removable or temporary cover plate.

The water closet fitting of this aspect of the invention comprises a first end adapted to engage a water closet drain system and a second end adapted to engage a water closet stool in a selectably permanent, releasable engagement. In preferred embodiments of this aspect of the invention the second end of said water closet fitting further comprises a flange adapted to engage a water closet stool by means of mechanical fasteners passing through holes in the flange.

In generally preferred embodiments of the invention the flange and the fitting (and/or its second end) comprise distinct pieces, and an inner circumferential surface of the flange is adapted for rotatable engagement with an outer circumferential surface of the fitting or its second end, whereby the flange may be selectably positioned to engage a water closet stool in a desired rotational orientation relative to said fitting so that the water closet stool may be attached to the fitting (albeit indirectly, via the flange) in a desired rotational orientation relative to the fitting. Most preferably, the flange and fitting are adapted to engage in such a manner—as for example by means of mating recesses, grooves, or channels and annular protrusions—as to restrain the flange from pulling away from the second end under a lifting force applied to the flange while allowing full rotational freedom of movement of the flange about the fitting.

The temporary or removable cover plate of this aspect of the invention is adapted to cover said second end in such fashion that upon installation of the fitting in an unset material such as concrete, comprising a poured floor, the cover prevents the material from entering the water closet fitting so that the water closet fitting and the drain system are kept free from the material. After the material has set the cover may be removed, the system tested, and a water closet stool may be installed by attachment of the stool to the second end of the water closet fitting. By saying that the cover is removable or temporary it is meant that when the floor has set and the cover may either be removed or physically removed or breached such that it entirely or substantially entirely clears the opening (i.e., the second end) of the water closet fitting, so that water and waste may transit freely through the fitting and a water closet stool may be easily and reliably attached. In preferred embodiments of this aspect of the invention, the cover plate and the second end of the fitting are adapted for flush alignment, when the second end of the fitting is covered by the cover, with the upper surface of the flooring material when the material is unset at pouring of the floor.

Preferred embodiments of this aspect of the invention further comprise a collar comprising a cupped annular ring adapted to engage the water closet fitting at or near the second end of the fitting and thereby to prevent contact between the flange, said mechanical fasteners, and said unset material during pouring and setting of the floor. Most preferably, the collar and the upper side of the cover are sized and fit together so that together they form a surface flush with the unset material when the floor is poured, so that upon removal of the cover after the floor has set the water closet fitting and flange are substantially flush with the floor, whereby mounting or attachment of the water closet stool is both functionally and aesthetically facilitated.

An optional but particularly beneficial aspect of this aspect of the invention comprises a means for facilitating testing of the water closet drain system once the water closet fitting and permanent floor have been installed. In such embodiments of the invention the water closet fitting described above further comprises, at its first end, a seat circumferentially disposed into an interior surface of the fitting for fluid tight engagement of a test baffle. The seat, being recessed in an interior surface of the fitting, has a diameter greater than an inside diameter of the fitting. The apparatus further comprises a test baffle adapted to be received in the interior seat. The test baffle is adapted to be received in the interior seat in the water closet fitting, and typically comprises a central web comprising a convex central dome and a means for removing the baffle after the drain system has been tested. While it is generally preferred that web of the baffle comprise a convex central dome, it is in some instances preferable to employ a flat web for the baffle instead. For example, it can be more economical to manufacture baffles comprising a flat web than a convex dome; and flat configurations may produce completely satisfactory results, particularly at relatively low test pressures. Most preferably, however, the web comprises a dome and the dome is oriented such it tends to resist by means of internal compression a pressure applied to the dome from inside the drain system. The test baffle is generally flexible and has an unflexed diameter exceeding the inside diameter of the fitting, and typically that of the seat as well. By activating the removal means the flexible baffle may then be removed from the drain system by way of the drain system, leaving behind no permanent structure or other material or portion of the baffle to obstruct or interfere with flow within the drain. Preferred embodiments of the test baffle comprise means for releasable interengagement of the baffle by the seat. Most preferably, such means comprise the provision of the baffle and the first (typically lower) end of the water closet fitting, preferably along the interior seat provided for the baffle, with a dependent member and a receiving member, with the dependent member being adapted for interfering or "snap" fit within the receiving member. Among other advantages, this allows the water closet fitting, with test baffle attached, to be installed easily, since as the fitting is placed into its installed position, with its first end in the typically down position, the test baffle stays in place while the water closet fitting is fitted to the drain system without need for holding the baffle in place by separate means and without the baffle being dislocated and interfering with the installation. Optional means for removably attaching the test baffle to the water closet fitting comprise integrally forming the test baffle with the first end of the fitting, and providing the test baffle at its junction with the fitting with a score line adjacent to said its seat in the first end, and a means for removing the test baffle by breaching the seal along the score line holding the baffle to the fitting.

BEST MODE OF CARRYING OUT THE INVENTION

Figure 1:
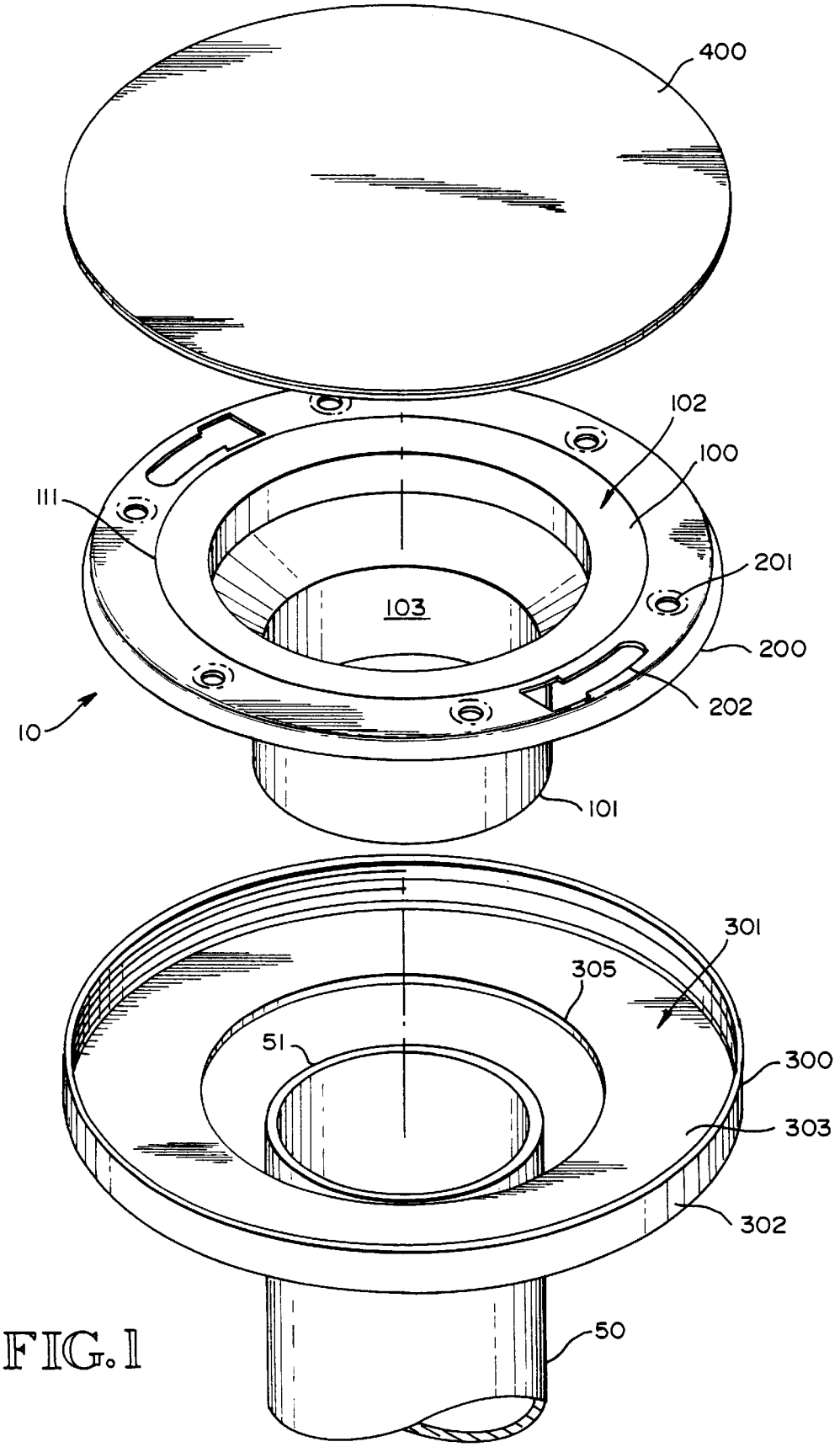
FIG. 1 is a perspective schematic view of a preferred embodiment of a water closet fitting installation assembly according to the invention.

As discussed herein a poured, permanently set floor is any floor, such as for example a concrete floor, which is liquid or malleable enough that it may be disposed in a position in which a floor is desired, molded or allowed to flow around any fittings or other structures intended to be left in place or to pass through the floor, and smoothed to form a substantially flat surface.

Turning now to the drawings, the invention will be described in a preferred embodiment by reference to the numerals of the drawing figures wherein like numbers indicate like parts.

Figure 2:
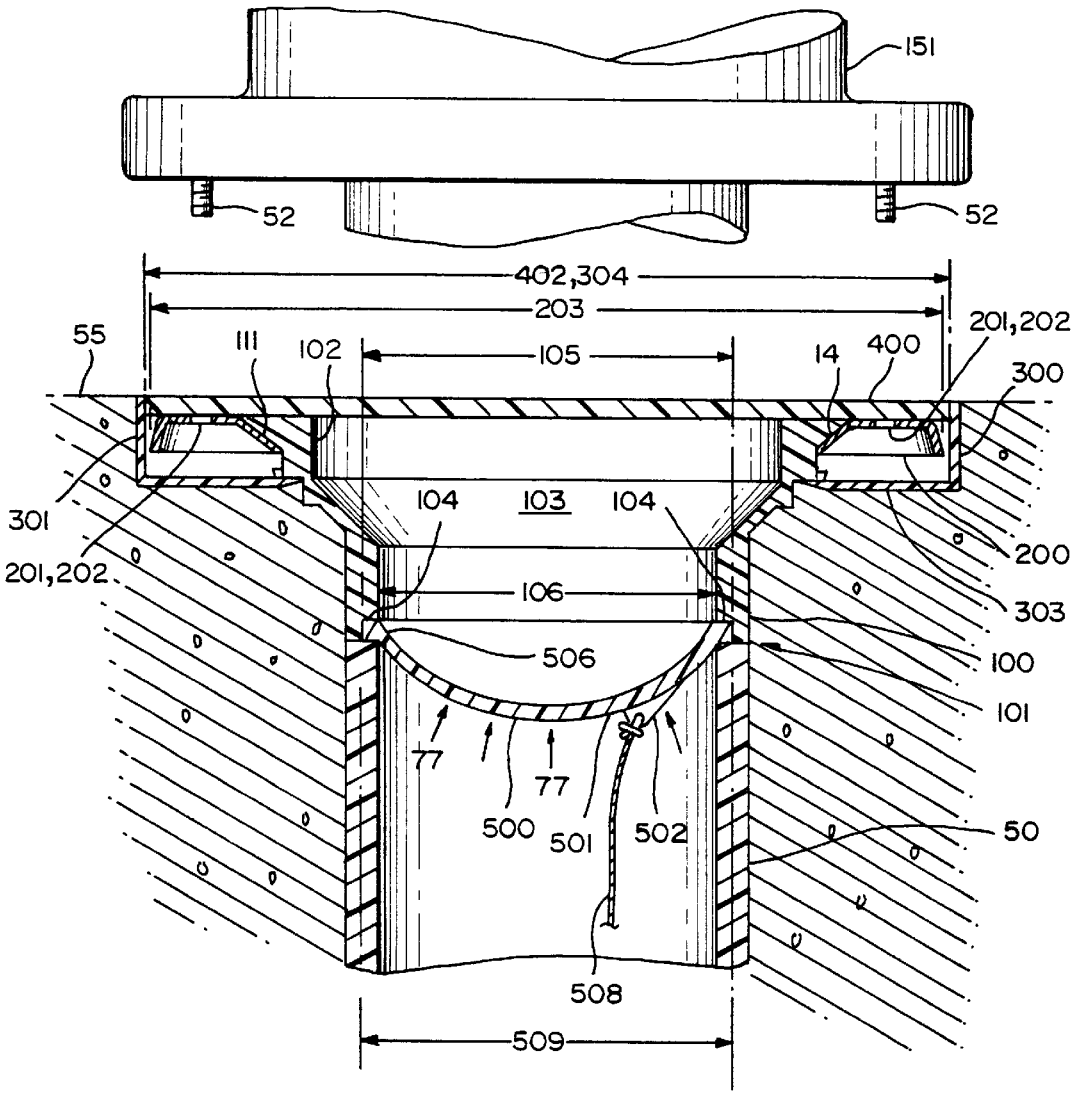
FIG. 2 is sectional schematic view of a preferred embodiment of a water closet fitting installation assembly according to the invention.

FIG. 1 is a perspective schematic view of a preferred embodiment of a water closet fitting installation assembly according to the invention. Installation assembly 10 comprises water closet fitting 100, flange 200, collar 300, and cover plate 400. Water closet fitting 100 comprises first end 101, second end 102, and interior surface 103. First end 101 of fitting 100 is adapted to engage end 51 of water closet drain system 50. Second end 102 is adapted to engage flange 200, which is adapted for rotatable engagement of outer circumference 111 of the second end, whereby the flange may be selectably positioned to engage a water closet stool (shown at 151 in FIG. 2) in a desired rotational orientation relative to fitting 100 by means of mechanical fasteners passing through holes in the flange (shown at 52 in FIG. 2). Collar 300 comprises cupped annular ring 301, which is adapted to engage fitting 100 proximate second end 102 in order to prevent contact between the flange, the water stool fasteners, and unset material during pouring and setting of the floor. As best seen in FIG. 2, cover plate 400 is adapted to removably cover second end 102 of the fitting in such manner that the cover and the second end, when the cover is in place, is aligned flush with a planned level for the surface of the floor (as for example surface 55 in FIG. 2).

A typical installation of an assembly according to this aspect of the invention is accomplished by placing a drain system 50 such that end 51 of the drain system is exposed within or above a sub-floor; and, with flange 200 and collar 300 in position around the circumference of the fitting's second end, attaching the fitting to the drain system. Attachment of the drain system and the water closet fitting may be accomplished in a great variety of ways, many of which are well known within the industry. A floor is then poured around the fitting and finished flush with the top of the fitting and the cover. As the floor is poured and sets, the collar prevents the floor material (as for example concrete) from coming into contact with and binding flange 200, and from blocking capacity for the installation of fasteners for the water closet stool. Thus flange 200 is left free to rotate about the fitting and to receive the water closet stool in any desired rotational orientation with respect to the fitting.

While flange 200 may comprise an integral part of the water closet fitting, it is generally preferred to fabricate the flange as a distinct part adapted for rotating engagement of the outer circumference of the second (typically the upper) end of the water closet fitting to allow selectable rotational orientation of the flange (and thereby the stool) with respect to the water closet fitting. When the fitting and the flange form a single integral part, the use of slots in the flange for accommodating the stool fasteners allows the stool to be selectably placed, albeit with a typically somewhat smaller degree of rotational freedom. In any case attachment of the stool to the flange typically restrains the stool from vertical displacements, and keeps the stool in place for proper drainage through the drain system. Second end 102 of the fitting, which is shown in its typical position as the upper end, is adapted to engage flange 200 by means of outer circumference 111, which may alternatively take the form of an annular channel. In either case the means for engaging the flange restricts the flange from substantial axial displacements with respect to fitting 100 (in the vertical direction as the fitting is shown in the Figure) and laterally as well (in the horizontal direction as shown), but allows the flange to rotate freely about the water closet fitting, at least until the stool fasteners are tightened. As indicated, rotation of flange 200 about the water closet fitting facilitates selective rotational positioning of a water closet stool on the water closet fitting, as for example to align the stool in conformance with the walls or layout or floor plan of a bathroom.

Flange 200 is adapted to engage water closet stool 151 in a selectably permanent, releasable engagement by means of bolts or other fasteners. In the embodiment shown bolts or machine screws 52 are provided on stool 151 to engage optional threaded fastener holes 201 in flange 200 and/or nuts or other suitable fastener means.

As indicated, collar 300 is adapted to engage fitting 100 proximate second end 102 of the fitting in order to prevent contact between the flange, the water stool fasteners, and unset material during pouring and setting of the floor. Thus the function of the collar is to shield those portions of the installation assembly from unset flooring material. In the embodiment shown, collar 300 comprises substantially axially oriented cylindrical ring portion 302 and substantially transverse or radial web portion 303. Web portion 303 is sized and adapted to engage a portion of the outer surface of the fitting, preferably while permitting, by means of an opening such as opening 305, passage of at least lower portions 101 of fitting 100, any extensions of the drain conduit 50, or other articles. The particular portion of the outer surface engaged by the web portion is not important, so long as the flange and the regions below it are shielded from contact with the flooring material to a depth sufficient to facilitate attachment of the water closet stool and to prevent adhesion or cementing of the flange to the water closet fitting. Thus the length (or depth) of cylindrical ring portion 302 must be great enough to facilitate such shielding. The selection of exact shaping and dimensions of the will not trouble the designer having ordinary skill in the art of designing water closet installations. For example, a variety of bowl-shaped or otherwise annular arrangements will serve quite satisfactorily.

Cover 400 serves to protect the inside and the upper surfaces of the water closet fitting, the flange, and the drain system from unwanted contact with unset flooring material. In order to facilitate the rapid and efficient installation of the floor, the cover most preferably takes the form of a flat plate or web essentially laid across the top of the fitting. Such embodiments of the cover permit the floor material to be poured around the fitting to a level flush with the top of the cover or the fitting, and spread smoothly about the fitting with a squeegee or other suitable instrument without interference from the fitting. Most typically the cover merely rests in place, although it may also be threaded in by means of threads provided on an inner surface of the collar (such as the upper portion of the cylindrical ring portion shown in the Figures), or provided with an interference or snap fit. Depending upon how it is installed, it may be removed very quickly and easily once the floor has set and the drain is ready for testing and/or installation of the water closet stool. In embodiments of the invention in which the cover is fabricated from metal, it has been found expedient in many circumstances to puncture the cover, once the floor has set, with the tangs of a hammer and then to pull the cover away.

In preferred embodiments the cover is adapted for flush installation with the floor. A typically preferred design for accomplishing this is shown in FIG. 2. By sizing collar 300, and in particular cylindrical ring portion 301 of the collar, such that its diameter is larger than that of flange 200 (as is typically the case, so that the collar may most efficiently serve its purpose) and just large enough to accommodate the outside diameter of the cover itself, a suitable arrangement may be obtained. For example, in FIG. 2 inside diameter 304 of cylindrical ring portion 301 is large enough to accomodate outside diameter 402 of the cover; both are larger than outside diameter 203 of the flange. Exact sizing and dimensioning (including selection of clearance tolerances) will not trouble the designer having ordinary skill in the art of drainage system design.

Figure 3:
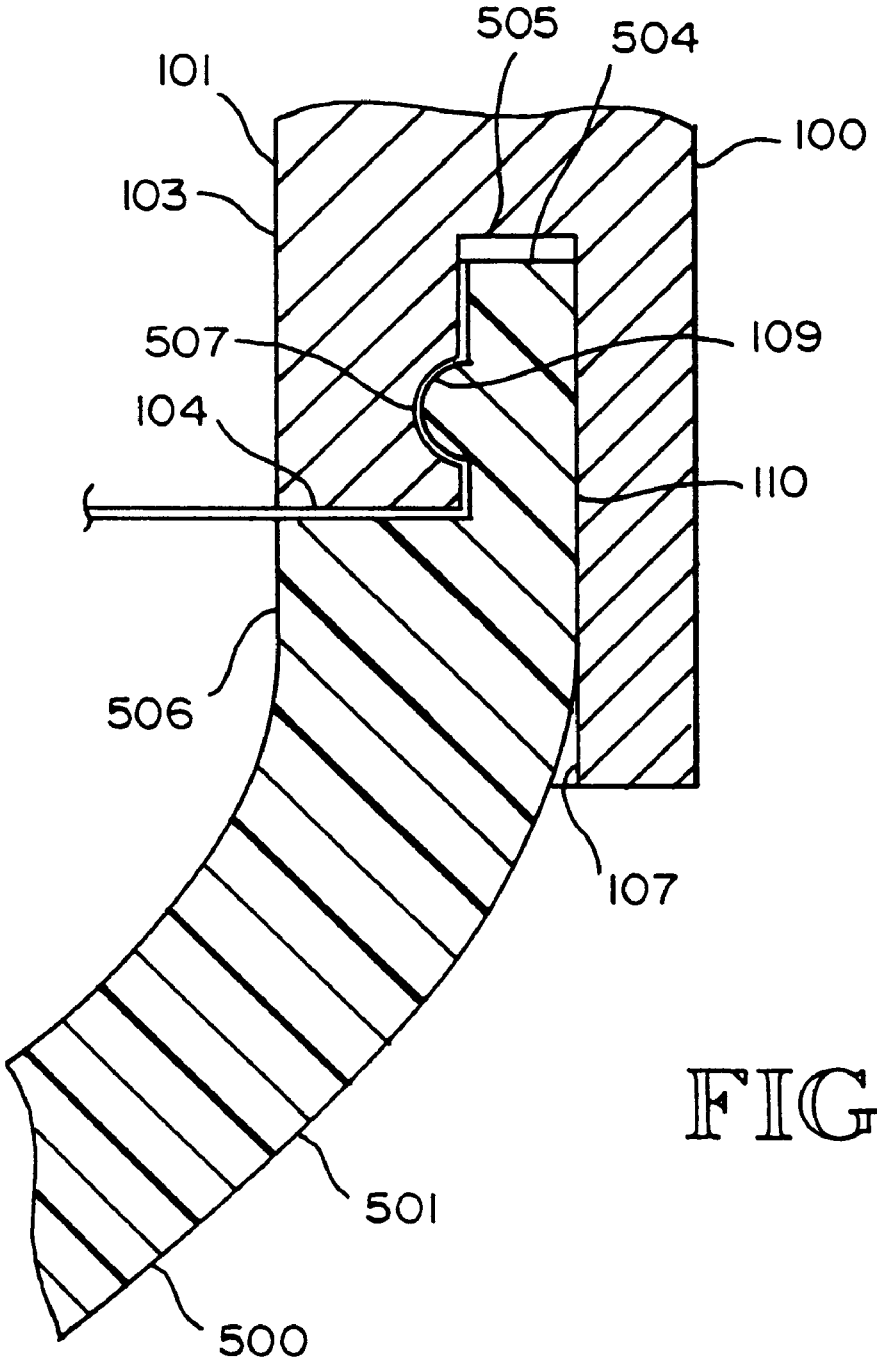
FIG. 3 is a sectional schematic view of a detail of a preferred embodiment of a water closet fitting installation assembly according to the invention.

FIG. 2 is sectional schematic view of an alternative preferred embodiment of a water closet fitting installation assembly according to the invention. The fitting shown in that Figure comprises circumferentially disposed seat 104, which has been recessed into interior surface 103 of the fitting for fluid tight engagement of test baffle 500 such that the seat has a diameter 509 which is greater than inside diameter 106 of the fitting. Seat 104 is adapted for reception of flexible test baffle 500, which comprises integral gasket 506, which has an unflexed diameter greater than that of inside diameter 106 of seat 104 and is therefore sized to be received, upon flexure of the baffle, in an interfering fit by gasket wall 107 (see FIG. 3) of seat 104, and thus to provide a fluid-tight seal between baffle 500 and water closet fitting 100, whereby pressure testing of the drain system may be accommodated. In the embodiment shown in FIG. 3, test baffle 500 further comprises optional dependent member or rim 504, which is adapted for releasable interfering fit with receiving member or channel 505 in fitting 100, preferably adjacent to gasket wall 107. By providing dependent member 504 and channel 505 with a raised radial ridge and a mating radial indentation such as radial ridge 109 and indentation 507 shown in FIG. 3, it is possible to conveniently and economically provide a "snap fit" between baffle 500 and seat 104, thus providing the attachment of the test baffle to the water closet fitting with greater security and an improved fluid tight integrity. Among other advantages, this allows the water closet fitting, with test baffle attached, to be easily installed, since as the fitting is placed into its installed position, with its first end in the typically down position, the test baffle stays in place while the water closet fitting is fitted to the drain system, without need for holding the baffle in place by separate means and without the baffle being dislocated and interfering with the installation. Test baffle 500 further comprises central web 501, which in the embodiment shown comprises a convex dome which enhances the pressure-resistant properties of the baffle. As shown in the Figures, dome 501 is oriented to most advantageously resist pressure within drainage system when the drainage system is tested by means of a pressure exerted in the direction of arrows 77 in FIG. 2. In the embodiment shown, dome 501 is substantially spherical in shape. In many cases the dome may advantageously be given a shape which is conical or stepped in the manner of a terrace or a Fresnel lens; or the central web may even be left flat. Regardless of shape, the dome is of sufficiently strong (especially when domed) to resist test loads commonly induced in the drain system in which it is installed during testing, without buckling, collapsing. or otherwise failing. Integral or separate gasket 506 aids baffle 500 in forming a fluid tight seal within the system. When the convex said of the baffle is subjected to a pressure in the sense indicated by arrows 77 in FIG. 2, the pressure is resisted by compression and relatively minor amounts of bending within the dome. The pressure load is transferred to gasket portion 506 of the baffle, which is pressed by the loads into even closer and more effective contact with seat of fitting 100. An integral formation of the gasket with the remainder of the baffle is generally preferred as the most convenient and sure means for providing a good seal, but the gasket may advantageously be provided as a separate part, or omitted altogether in some situations, particularly where relatively low test pressures are anticipated. Preferred embodiments of test baffle 500 further comprise a means for removal of the baffle from the water closet fitting and from the drain system when testing has been completed. The removal means may comprise a line or cord such as cord 508 attached to the baffle and operated by pulling to remove the baffle from the system or other portion of the conduit. The removal means, such as line or cord 508, may extend from the baffle through the drainage system to an exit port or to a point located near an access or cleanout port such as is commonly used in the industry to keep drains cleared of other material. Alternatively, a hook or other tool may be used to engage the baffle through an adjacent cleanout port. Means such as removal lug 502 are preferably provided on the baffle for engagement of the removal means. A lug is particularly well adapted for use with either a cord or hook. Thus by activating the removal means the flexible baffle may then be removed from the drain system by way of the drain system, leaving behind no permanent structure or other material or portion of the baffle to obstruct or interfere with flow within the drain. An optional means for removably attaching the test baffle to the water closet fitting comprises integral formation of the test baffle with the first end of the fitting and provision of the test baffle at its junction with the fitting with a score line adjacent to said its seat in the first end, and a means for removing the test baffle by breaching the seal along the score line holding the baffle to the fitting.

In embodiments of the invention comprising test baffles, seat 104 may be formed by conventional molding or casting techniques in the water closet fitting, but may also be machined or otherwise formed. For example, an interior circumferential groove may be cut into the interior wall of the fitting. Any means of providing the type of relief within the inner surface of the fitting shown in or suggested by the Figures will suffice.

The water closet fitting, flange, collar, cover, and test baffle of the invention are preferably formed of plastic, metal, or any other substance having suitable strength, durability, fatigue resistance, damage tolerance, and corrosion resistance for the purposes indicated herein. Particularly preferred embodiments of the water closet fitting are made of polyvinyl chloride or other relatively strong, rigid, and impact- and corrosion resistant polymer; preferred flanges are of metal, so that the potentially relatively large loads induced in the flange by fasteners attaching the stool may be effectively supported. Preferred embodiments of the test baffle are made of flexible plastic or other suitably soft or flexible polymer, or of suitably hard rubber or other elastomer, so that when it is desired to remove the baffle it may be disengaged from the seat and removed from the system through flexure.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

INDUSTRIAL APPLICABILITY

The invention provides improvements in water closet installation assemblies and drain system fittings. In particular, it provides method and apparatus for convenient and efficient flush installation of water closet fittings and stools in poured permanent floors, and for facilitating pressure testing of water closet drain systems in poured permanent floors after installation.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A water closet fitting installation assembly for installation of a water closet fitting within a poured, permanently set floor, the assembly comprising:

a water closet fitting having a first end and a second end, the first end adapted to engage a water closet drain system;

a flange adapted for rotatable engagement of an outer circumference of said second end, whereby the flange may be selectably positioned to engage a water closet stool in a desired rotational orientation relative to said fitting by means of mechanical fasteners passing through holes in the flange;

a collar comprising a cupped annular ring adapted to receive said flange and said second end, and thereby to prevent contact between said flange, said mechanical fasteners, and unset material during pouring and setting of the floor; and a cover plate adapted to removably cover said second end, the cover and the second end adapted to be in flush alignment, when the second end is covered by the cover, with an upper surface of said unset material when the floor is poured;

whereby, upon installation of said fitting in an unset material comprising a poured floor, said removable cover prevents unset material from entering the water closet fitting, so that said fitting and said drain system are kept free from the material.

2. The assembly of claim 1, wherein said first end of the fitting comprises a seat circumferentially disposed into an interior surface of said fitting for fluid tight engagement of a test baffle, said seat having a diameter greater than an inside diameter of the fitting;

the apparatus further comprising a test baffle adapted to be received in said interior seat, the baffle comprising a convex central dome, having an unflexed diameter exceeding the inside diameter of said fitting, and being flexible, whereby said baffle may be flexed for removal from said fitting without leaving any portion of said baffle within said drain system, said convex central dome oriented such the dome tends to resist by means of internal compression a pressure applied to said dome from said drain system;

whereby said water closet drain system may be tested for fluid tight integrity without fouling said drain system with the test baffle.

3. The assembly of claim 2, said test baffle further comprising means for removal of the baffle from the fitting and the drain system following testing of the drain system.

4. The assembly of claim 2, wherein said seat and said test baffle comprise means for releasable interengagement of the baffle by the seat.

5. The assembly of claim 4, wherein said means for releasable engagement comprises a dependent member and a receiving member, the dependent member adapted for interfering fit within the receiving member.

6. A water closet fitting installation assembly for installation of a water closet fitting within a poured, permanently set floor, the assembly comprising:

a water closet fitting having a first end adapted to engage a water closet drain system and a second end adapted to engage a water closet stool in a selectably permanent, releasable engagement;

a cover plate adapted to removably cover said second end;

whereby upon installation of said fitting in an unset material comprising a poured floor said removable cover prevents the material from entering the water closet fitting, so that said fitting and said drain system are kept free from the material wherein said temporary cover and said second end are adapted to be in flush alignment, when said second end is covered by said cover, with an upper surface of said unset material when the floor is poured; wherein said second end of said water closet fitting further comprises a flange adapted to engage a water closet stool by means of mechanical fasteners passing through holes in the flange; and a collar comprising a cupped annular ring adapted to receive said flange and said second end and thereby to prevent contact between said flange, said mechanical fasteners, and said unset material during pouring and setting of the floor.

7. The assembly of claim 6, wherein said collar and an upper side of said cover are flush with said unset material when the floor is poured.

8. The assembly of claim 7, wherein said flange and said second end comprise distinct pieces, and an inner circumferential surface of said flange is adapted for rotatable engagement with an outer circumferential surface of said second end, whereby the flange may be selectably positioned to engage a water closet stool in a desired rotational orientation relative to said fitting.

9. The assembly of claim 6, wherein said first end of said fitting comprises a seat circumferentially disposed into an interior surface of said fitting for fluid tight engagement of a test baffle, said seat having a diameter greater than an inside diameter of the fitting;

the apparatus further comprising a test baffle adapted to be received in said interior seat, the baffle comprising a convex central dome, having an unflexed diameter exceeding said inside diameter of said fitting, and being flexible, whereby said baffle may be flexed for removal from said fitting without leaving any portion of said baffle within said drain system, said convex central dome oriented such the dome tends to resist by means of internal compression a pressure applied to said dome from said drain system;

whereby said water closet drain system may be tested for fluid tight integrity.

10. The assembly of claim 9, said test baffle further comprising means for removal of the baffle from the fitting and the drain system following testing of the drain system.

11. The assembly of claim 9, wherein said seat and said test baffle comprise means for releasable interengagement of the baffle by the seat.

12. The assembly of claim 11, wherein said means for releasable engagement comprises a dependent member and a receiving member, the dependent member adapted for interfering fit within the receiving member.

* * * * *